US012760228B2

(12) United States Patent
Kandanelli et al.

(10) Patent No.: US 12,760,228 B2
(45) Date of Patent: Oct. 13, 2026

(54) DEWATERING COMPOSITION AND IMPLEMENTATIONS THEREOF

(71) Applicant: Hindustan Petroleum Corporation Limited, Hoskote Taluk (IN)

(72) Inventors: Ramesh Kandanelli, Hoskote Taluk (IN); Raghava Krishna Kanala, Hoskote Taluk (IN); Dhiravidaselvi Kb, Hoskote Taluk (IN); Ravi B, Hoskote Taluk (IN)

(73) Assignee: Hindustan Petroleum Corporation Limited, Bangalore (IN)

( * ) Notice: Subject to any disclaimer, the term of this patent is extended or adjusted under 35 U.S.C. 154(b) by 558 days.

(21) Appl. No.: 18/037,175

(22) PCT Filed: Oct. 27, 2021

(86) PCT No.: PCT/IB2021/059922
§ 371 (c)(1),
(2) Date: May 16, 2023

(87) PCT Pub. No.: WO2022/101729
PCT Pub. Date: May 19, 2022

(65) Prior Publication Data

US 2024/0018420 A1 Jan. 18, 2024

(30) Foreign Application Priority Data

Nov. 16, 2020 (IN) ..... 202041049913

(51) Int. Cl.
*C10G 33/04* (2006.01)

(52) U.S. Cl.
CPC ..... *C10G 33/04* (2013.01)

(58) Field of Classification Search
None
See application file for complete search history.

(56) References Cited

U.S. PATENT DOCUMENTS

| | | | | |
|---|---|---|---|---|
| 3,880,613 | A * | 4/1975 | Oswald | C10L 1/143 514/642 |
| 4,516,981 | A * | 5/1985 | Nelson, Jr. | C09K 23/018 516/191 |
| 5,539,044 | A | 7/1996 | Dindi et al. | |
| 2016/0264837 | A1* | 9/2016 | Nelson | E21B 33/13 |
| 2018/0079977 | A1 | 3/2018 | Solomon | |
| 2018/0291256 | A1 | 10/2018 | Alwattari et al. | |
| 2020/0231519 | A1* | 7/2020 | Abudawoud | C07C 15/067 |
| 2021/0292668 | A1 | 9/2021 | Sleat et al. | |
| 2024/0110096 | A1* | 4/2024 | Alamri | C23F 11/161 |

FOREIGN PATENT DOCUMENTS

| | | | |
|---|---|---|---|
| EP | 0885259 | B1 | 12/2003 |
| WO | 2015061262 | A1 | 4/2015 |
| WO | 2016163993 | A1 | 10/2016 |
| WO | 2018053248 | A1 | 3/2018 |
| WO | 2018142131 | A1 | 8/2018 |

* cited by examiner

*Primary Examiner* — Jeffrey D Washville
(74) *Attorney, Agent, or Firm* — McDonnell Boehnen Hulbert & Berghoff LLP

(57) ABSTRACT

The present disclosure provides a composition for dewatering a hydrocarbon feed, the composition comprising: a) at least two alkyl poly-ethoxy alcohol; and b) at least one non-ionic surfactant, wherein the at least two alkyl poly-ethoxy alcohol to the at least one non-ionic surfactant weight ratio is in the range of 0.75:1.5 to 1.5:3.0.

11 Claims, 2 Drawing Sheets

DEWATERING COMPOSITION AND IMPLEMENTATIONS THEREOF

This application is a U.S. national phase of International Application No. PCT/IB2021/059922, filed on Oct. 27, 2021, which claims priority to Indian Application No. 202041049913, filed Nov. 16, 2020, both of which are incorporated by reference herein in their entirety.

FIELD OF THE INVENTION

The present disclosure in general relates to the field of refineries and in particular the present disclosure relates to dewatering hydrocarbon feed in refineries.

BACKGROUND OF THE INVENTION

Hydrocarbon feed used in the refinery units ranges from heavy crudes to light crudes based on its composition. Crude oil is a mixture that consists of hydrocarbons such as paraffins, iso-paraffins, aromatics, resins and asphaltenes. The crude oil also contains impurities such as sediments, mud, water and heavy metals. Crude oil shipped through marine tankers is received in large storage tanks in refineries prior to processing. Water and sediments in the crude oil should be removed prior to processing in downstream units. Generally, water is drained by giving a settling time of 8-12 hours for the crude in the storage tanks. However oil-water emulsion settles along with the other inorganic impurities at the bottom of the tank and forms sludge. This sludge accumulated over prolonged period of time needs to be removed and disposed, as, it may lead to economic losses by means of loss of storage volume and tank corrosion. However, removal and disposal of water with sludge demands manpower, very intensive mechanical process and also has severe environmental implications.

Removal of sludge and water from the crude oil storage tank is essential as it provides more space for storage and further improves operability of the storage tanks. Inorganic solids in the crude oil, such as clay, silica, calcite, and corrosion-produced residues, forms a heavier deposit which will be difficult to remove later. Hence it is essential to perform the dewatering process regularly in the storage tanks. Further this would also improve the quality of water and the water settling rate in the storage tanks and is an economically viable process.

However, the challenge in developing a dewatering composition remains in removal of free water, emulsified water and dissolved water in the form of sludge. Although there are numerous efforts attempted, there is still a need in the state of art for obtaining a composition for dewatering the hydrocarbon feed effectively at a faster rate and in economical way.

SUMMARY OF THE INVENTION

In an aspect of the present disclosure, there is provided a composition for dewatering a hydrocarbon feed, the composition comprising: a) at least two alkyl poly-ethoxy alcohol; and b) at least one non-ionic surfactant, wherein the at least two alkyl poly-ethoxy alcohol to the at least one non-ionic surfactant weight ratio is in the range of 0.75:1.5 to 1.5:3.0.

In another aspect of the present disclosure, there is provided a process for dewatering a hydrocarbon feed, the process comprising: a) obtaining a hydrocarbon feed; b) obtaining the composition comprising: a) at least two alkyl poly-ethoxy alcohol; and b) at least one non-ionic surfactant, wherein the at least two alkyl poly-ethoxy alcohol to the at least one non-ionic surfactant weight ratio is in the range of 0.75:1.5 to 1.5:3.0; and c) contacting the composition with the hydrocarbon feed to separate water and dewatered hydrocarbon feed, wherein the composition is in a weight ratio range of 0.0001 to 0.005% with respect to the hydrocarbon feed.

These and other features, aspects, and advantages of the present subject matter will be better understood with reference to the following description and appended claims. This summary is provided to introduce a selection of concepts in a simplified form. This summary is not intended to identify key features or essential features of the claimed subject matter, nor is it intended to be used to limit the scope of the claimed subject matter.

BRIEF DESCRIPTION OF DRAWINGS

The detailed description is described with reference to the accompanying figures. In the figures, the left-most digit(s) of a reference number identifies the figure in which the reference number first appears. The same numbers are used throughout the drawings to reference like features and components.

DETAILED DESCRIPTION OF THE INVENTION

Figure 1:
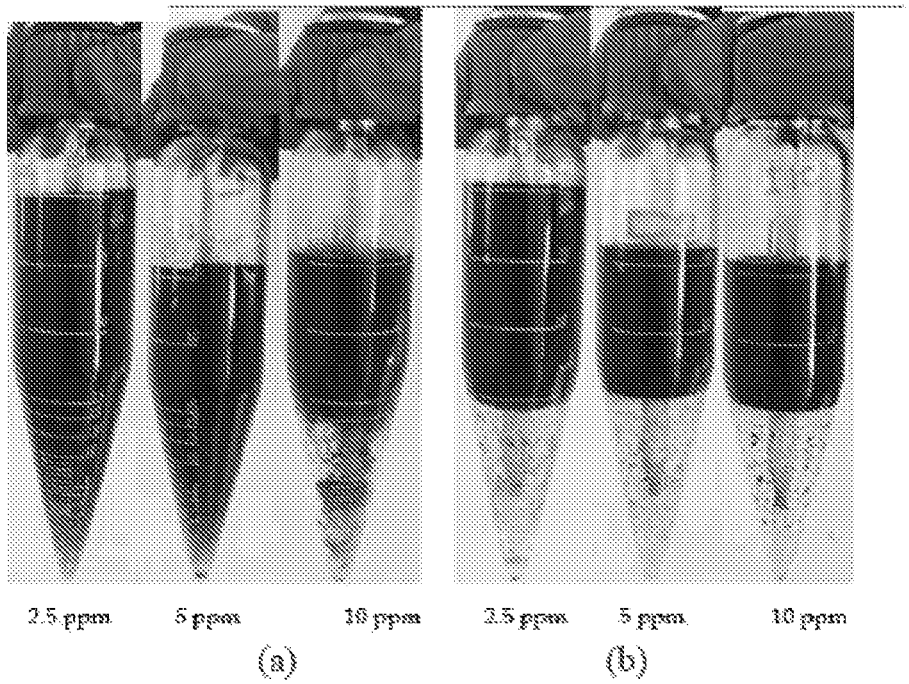
FIG. 1 (*a, b*) represents the images of water separation from hydrocarbon feed in the presence of benchmark additive (a) and dewatering composition (b) at various dosages, in accordance with an implementation of the present disclosure.

Those skilled in the art will be aware that the present disclosure is subject to variations and modifications other than those specifically described. It is to be understood that the present disclosure includes all such variations and modifications. The disclosure also includes all such steps, features, compositions and compounds referred to or indicated in this specification, individually or collectively, and any and all combinations of any or more of such steps or features.

Definitions

For convenience, before further description of the present disclosure, certain terms employed in the specification, and examples are collected here. These definitions should be read in the light of the remainder of the disclosure and understood as by a person of skill in the art. The terms used herein have the meanings recognized and known to those of skill in the art, however, for convenience and completeness, particular terms and their meanings are set forth below.

The articles "a", "an" and "the" are used to refer to one or to more than one (i.e., to at least one) of the grammatical object of the article.

The term "at least" refers to not less than or at a minimum. The term "at least one" refers to minimum one or more than one. The term "at least two" refers to minimum two or more than two.

The terms "comprise" and "comprising" are used in the inclusive, open sense, meaning that additional elements may be included. It is not intended to be construed as "consists of only".

The term "dewatering" refers to the process of removal of water from a mixture. In the present disclosure, dewatering refers to separation of water from hydrocarbon feed. The composition that aids in dewatering process is referred herein as "dewatering composition" or "composition for dewatering". Dewatering composition is added to the hydrocarbon feed and is subjected to dewatering process.

The term "hydrocarbon feed" as used herein refers to the crude oil feedstocks in the petroleum refineries. In the present disclosure, the hydrocarbon feed includes but not limited to crude oil, light crudes, heavy crudes and the like.

The term "alkyl poly-ethoxy alcohol" used herein refers to long chain alkyl alcohol with more than one ethoxy group. In the present disclosure alkyl poly-ethoxy alcohol includes but not limited to polysorbate 20, polysorbate 40, polysorbate 80, polyethylene glycol 200, polyethylene glycol 400, polyethylene glycol 1500.

The term "nonionic surfactant" used herein refers to surfactants that do not dissociate into ions in aqueous solutions, and they are subclassified depending on the type of their hydrophilic/lipophilic group. In the present disclosure, the nonionic surfactant includes but is not limited to triton X, octyl phenol alkoxylate, nonylphenol ethoxylate, and tergitol.

The term "biocide" refers to a chemical that inhibits the growth of microorganisms and subsequently prevents microbiologically induced corrosion. In the present disclosure, biocide is used to reduce the microorganisms so as to avoid tank bottom corrosion. In the present disclosure, biocide includes but is not limited to quaternary $C_{8-18}$ alkyl ammonium chlorides, quaternary $C_{8-18}$ alkanol ammonium chlorides, and bronopol.

The term "diluent" refers to a solvent which acts as a diluting agent. The diluent decreases the viscosity thereby enabling the flow of fluids to which it is added. In the present disclosure diluent is used to deliver the key components in the composition at oil-water interface. In the present disclosure, diluent includes but not limited to superior kerosene oil, naphtha, hexane, heptane, xylene, ethanol, propanol, butanol, pentanol, hexanol, isooctane, and toluene.

The term "dewatered hydrocarbon feed" refers to the hydrocarbon feed without water. The hydrocarbon feed contains free water, emulsified water and dissolved water which will result in the formation of sludge. The process defined in the present disclosure separates the free water, emulsified water and the dissolved water in the hydrocarbon feed thereby leaving behind dewatered hydrocarbon feed.

The term "benchmark additive" refers to the hydrocarbon feed with the commercially available dewatering composition. The terms "benchmark additive", "benchmark sample", "benchmark" can be used interchangeably.

The term "blank" refers to the hydrocarbon feed without addition of any dewatering composition. The terms "blank sample", "blank" can be used interchangeably.

The term "ASTM G170 (section 9.3) method" refers to the standard measurement technique for determining the extent of separation of water in oil during corrosion inhibition evaluation. In the present disclosure, the method is used for extent of separation of water in the crude oil-water mixture.

The term "ppm" refers to parts per million and is used to denote the concentration of a substance. It can also be referred to as mg per litre or mg per kilogram. In the present disclosure, the dewatering composition is added in parts per million with respect to the concentration of hydrocarbon feed.

The term "ptb" refers to pounds of salt per thousand barrels of crude oil. In the present disclosure, the dewatered hydrocarbon feed is analyzed for the presence of amount of salt content in it and is expressed in ptb.

Throughout this specification, unless the context requires otherwise the word "comprise", and variations such as "comprises" and "comprising", will be understood to imply the inclusion of a stated element or step or group of element or steps but not the exclusion of any other element or steps.

The term "including" is used to mean "including but not limited to", "including" and "including but not limited to" are used interchangeably.

Unless defined otherwise, all technical and scientific terms used herein have the same meaning as commonly understood to one of ordinary skill in the art to which this disclosure belongs. Although methods and materials similar or equivalent to those described herein can be used in the practice or testing of the disclosure, the preferred methods, and materials are now described. All publications mentioned herein are incorporated herein by reference.

Ratios, concentrations, amounts, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For example, a weight percentage of about 30% to 50% should be interpreted to include not only the explicitly recited limits of about 30% and 50%, but also to include sub-ranges, such as 31-49%, 35-50%, and so forth, as well as individual amounts, including fractional amounts, within the specified ranges, such as 30.9%, 45.5%, 48.2%, for example.

The present disclosure is not to be limited in scope by the specific embodiments described herein, which are intended for the purposes of exemplification only. Functionally equivalent products, compositions, and methods are clearly within the scope of the disclosure, as described herein.

As discussed in the background, there were various processes and composition used in the dewatering of hydrocarbon feed. However, the challenges of complete removal of free as well as dissolved water still remains. And the dewatering process is recurring process in the storage tank hence the cost incurrence is also essential to be addressed. Thus there requires a composition for dewatering the hydrocarbon feed to overcome these issues.

The present disclosure reveals a composition for dewatering the hydrocarbon feed including the combined performance of alkyl poly-ethoxy alcohol and non-ionic surfactant. The alkyl poly-ethoxy alcohol gets solubilized in free, emulsified and dissolved water present in hydrocarbon feed and changes the viscoelastic forces at the interface and thereby enhancing the rate of water separation. The emulsion between oil and water is stabilized by asphaltenes which act as natural surfactants. Hence the non-ionic surfactants in the dewatering composition acts in such a way that said asphaltenes are dispersed and tiny droplets of water are free to combine and form larger droplets and subsequently settle down due to difference in density, thereby assisting the separation of dissolved/emulsified water. The composition further comprises a biocide and a diluent which aids in the dewatering process. Biocide prevents the tank bottom corrosion and the diluent enhances the interactions of components with oil-water interface. The present disclosure also discloses the rate of separation of water from hydrocarbon feed. In a nutshell, the present disclosure provides a proficient composition for dewatering the hydrocarbon feed.

In an embodiment of the present disclosure, there is provided a composition for dewatering a hydrocarbon feed, the composition comprising: a) at least two alkyl poly-ethoxy alcohol; and b) at least one non-ionic surfactant, wherein the at least two alkyl poly-ethoxy alcohol to the at least one non-ionic surfactant weight ratio is in the range of 0.75:1.5 to 1.5:3.0.

In an embodiment of the present disclosure, there is provided a composition for dewatering a hydrocarbon feed as disclosed herein, wherein the at least two alkyl poly-ethoxy alcohol to the at least one non-ionic surfactant weight ratio is in the range of 0.8:1.4 to 1.4:2.8. In another embodiment of the present disclosure, there is provided a composition for dewatering a hydrocarbon feed as disclosed herein, wherein the at least two alkyl poly-ethoxy alcohol to the at least one non-ionic surfactant weight ratio is in the range of 0.9:1.3 to 1.3:2.75. In yet another embodiment of the present disclosure, there is provided a composition for dewatering a hydrocarbon feed as disclosed herein, wherein the at least two alkyl poly-ethoxy alcohol to the at least one non-ionic surfactant weight ratio is of 1:1. In an embodiment of the present disclosure, there is provided a composition for dewatering a hydrocarbon feed having two alkyl poly-ethoxy alcohol and a non-ionic surfactant, wherein the weight ratio of the alkyl poly-ethoxy alcohol and a non-ionic surfactant is in the range of 0.8:1.4 to 1.4:2.8, preferably in the range of 0.9:1.3 to 1.3:2.75. In yet another embodiment of the present disclosure, there is provided a composition for dewatering a hydrocarbon feed as disclosed herein, wherein the two alkyl poly-ethoxy alcohol to the at least one non-ionic surfactant weight ratio is of 1:1.

In an embodiment of the present disclosure, there is provided a composition for dewatering a hydrocarbon feed as disclosed herein, wherein the at least two alkyl poly-ethoxy alcohol is selected from the group consisting of polysorbate 20, polysorbate 40, polysorbate 80, polyethylene glycol 200, polyethylene glycol 400, and polyethylene glycol 1500. In another embodiment of the present disclosure, there is provided a composition for dewatering a hydrocarbon feed as disclosed herein, wherein the at least two alkyl poly-ethoxy alcohol is selected from the group consisting of polysorbate 20, polysorbate 40, polysorbate 80, polyethylene glycol 200 and polyethylene glycol 400. In yet another embodiment of the present disclosure, there is provided a composition for dewatering a hydrocarbon feed as disclosed herein, wherein the at least two alkyl poly-ethoxy alcohol is selected from the group consisting of polysorbate 20, polysorbate 40 and polysorbate 80.

In an embodiment of the present disclosure, there is provided a composition for dewatering a hydrocarbon feed as disclosed herein, wherein the at least two alkyl poly-ethoxy alcohol is a combination of polysorbate 20 and polysorbate 40.

In an embodiment of the present disclosure, there is provided a composition for dewatering a hydrocarbon feed, the composition comprising: a) at least two alkyl poly-ethoxy alcohol selected from the group consisting of polysorbate 20, polysorbate 40, polysorbate 80, polyethylene glycol 200, polyethylene glycol 400, and polyethylene glycol 1500; and b) at least one non-ionic surfactant, wherein the at least two alkyl poly-ethoxy alcohol to the at least one non-ionic surfactant weight ratio is in the range of 0.75:1.5 to 1.5:3.0.

In an embodiment of the present disclosure, there is provided a composition for dewatering a hydrocarbon feed, the composition comprising: a) at least two alkyl poly-ethoxy alcohol is a combination of polysorbate 20 and polysorbate 40; and b) at least one non-ionic surfactant, wherein the at least two alkyl poly-ethoxy alcohol to the at least one non-ionic surfactant weight ratio is in the range of 0.75:1.5 to 1.5:3.0.

In an embodiment of the present disclosure, there is provided a composition for dewatering a hydrocarbon feed, the composition as disclosed herein, wherein the polysorbate 20 to the polysorbate 40 weight ratio is 1:1.

In an embodiment of the present disclosure, there is provided a composition for dewatering a hydrocarbon feed, the composition comprising: a) at least two alkyl poly-ethoxy alcohol is a combination of polysorbate 20 and polysorbate 40 in the weight ratio of 1:1; and b) at least one non-ionic surfactant, wherein the at least two alkyl poly-ethoxy alcohol to the at least one non-ionic surfactant weight ratio is in the range of 0.75:1.5 to 1.5:3.0.

In an embodiment of the present disclosure, there is provided a composition for dewatering a hydrocarbon feed as disclosed herein, wherein the at least one non-ionic surfactant is selected from triton X, octyl phenol alkoxylate, nonylphenol ethoxylate, or tergitol.

In an embodiment of the present disclosure, there is provided a composition for dewatering a hydrocarbon feed as disclosed herein, wherein the at least one non-ionic surfactant is selected from triton X, octyl phenol alkoxylate or nonylphenol ethoxylate. In another embodiment of the present disclosure, there is provided a composition for dewatering a hydrocarbon feed as disclosed herein, wherein the at least one non-ionic surfactant is triton X, or octyl phenol alkoxylate. In yet another embodiment of the present disclosure, there is provided a composition for dewatering a hydrocarbon feed as disclosed herein, wherein the at least one non-ionic surfactant is triton X.

In an embodiment of the present disclosure, there is provided a composition for dewatering a hydrocarbon feed, the composition comprising: a) at least two alkyl poly-ethoxy alcohol; and b) at least one non-ionic surfactant selected from triton X, octyl phenol alkoxylate, nonylphenol ethoxylate, or tergitol, wherein the at least two alkyl poly-ethoxy alcohol to the at least one non-ionic surfactant weight ratio is in the range of 0.75:1.5 to 1.5:3.0

In an embodiment of the present disclosure, there is provided a composition for dewatering a hydrocarbon feed, the composition comprising: a) at least two alkyl poly-ethoxy alcohol selected from the group consisting of polysorbate 20, polysorbate 40, polysorbate 80, polyethylene glycol 200, polyethylene glycol 400, and polyethylene glycol 1500; and b) at least one non-ionic surfactant selected from triton X, octyl phenol alkoxylate, nonylphenol ethoxylate, or tergitol, wherein the at least two alkyl poly-ethoxy alcohol to the at least one non-ionic surfactant weight ratio is in the range of 0.75:1.5 to 1.5:3.0

In an embodiment of the present disclosure, there is provided a composition for dewatering a hydrocarbon feed as disclosed herein, wherein the at least one non-ionic surfactant is triton X.

In an embodiment of the present disclosure, there is provided a composition for dewatering a hydrocarbon feed, the composition comprising: a) at least two alkyl poly-ethoxy alcohol is a combination of polysorbate 20 and polysorbate 40 in the weight ratio of 1:1; and b) at least one non-ionic surfactant is triton X, wherein the at least two alkyl poly-ethoxy alcohol to the at least one non-ionic surfactant weight ratio is in the range of 0.75:1.5 to 1.5:3.0.

In an embodiment of the present disclosure, there is provided a composition for dewatering a hydrocarbon feed, the composition comprising: a) at least two alkyl poly-ethoxy alcohol is a combination of polysorbate 20 and polysorbate 40 in the weight ratio of 1:1; and b) at least one non-ionic surfactant is triton X, wherein the at least two alkyl poly-ethoxy alcohol to the at least one non-ionic surfactant weight ratio of 1:1.

In an embodiment of the present disclosure, there is provided a composition for dewatering a hydrocarbon feed as disclosed herein, wherein the at least two alkyl poly-ethoxy alcohol has a weight percentage in the range of 30-50% with respect to the composition; the at least one non-ionic surfactant has a weight percentage in the range of 30-50% with respect to the composition.

In an embodiment of the present disclosure, there is provided a composition for dewatering a hydrocarbon feed as disclosed herein, wherein the at least two alkyl poly-ethoxy alcohol has a weight percentage in the range of 32-48% with respect to the composition; the at least one non-ionic surfactant has a weight percentage in the range of 32-48% with respect to the composition. In another embodiment of the present disclosure, there is provided a composition for dewatering a hydrocarbon feed as disclosed herein, wherein the at least two alkyl poly-ethoxy alcohol has a weight percentage in the range of 35-45% with respect to the composition; the at least one non-ionic surfactant has a weight percentage in the range of 35-45% with respect to the composition. In yet another embodiment of the present disclosure, there is provided a composition for dewatering a hydrocarbon feed as disclosed herein, wherein the at least two alkyl poly-ethoxy alcohol has a weight percentage of 40% with respect to the composition; the at least one non-ionic surfactant has a weight percentage of 40% with respect to the composition.

In an embodiment of the present disclosure, there is provided a composition for dewatering a hydrocarbon feed, the composition comprising: a) at least two alkyl poly-ethoxy alcohol; and b) at least one non-ionic surfactant, wherein the at least two alkyl poly-ethoxy alcohol to the at least one non-ionic surfactant weight ratio is in the range of 0.75:1.5 to 1.5:3.0 and the at least two alkyl poly-ethoxy alcohol has a weight percentage in the range of 30-50% with respect to the composition; the at least one non-ionic surfactant has a weight percentage in the range of 30-50% with respect to the composition.

In an embodiment of the present disclosure, there is provided a composition for dewatering a hydrocarbon feed as disclosed herein, further comprises at least one diluent having weight percentage in the range of 10-30% with respect to the composition.

In an embodiment of the present disclosure, there is provided a composition for dewatering a hydrocarbon feed as disclosed herein, further comprises at least diluent having weight percentage in the range of 12-28% with respect to the composition. In another embodiment of the present disclosure, there is provided a composition for dewatering a hydrocarbon feed as disclosed herein, further comprises at least one diluent having weight percentage in the range of 15-25% with respect to the composition. In yet another embodiment of the present disclosure, there is provided a composition for dewatering a hydrocarbon feed as disclosed herein, further comprises at least one diluent having weight percentage of 15% with respect to the composition.

In an embodiment of the present disclosure, there is provided a composition for dewatering a hydrocarbon feed as disclosed herein, wherein the at least two alkyl poly-ethoxy alcohol has a weight percentage in the range of 30-50% with respect to the composition; the at least one non-ionic surfactant has a weight percentage in the range of 30-50% with respect to the composition, further comprises at least one diluent having weight percentage in the range of 10-30% with respect to the composition.

In an embodiment of the present disclosure, there is provided a composition for dewatering a hydrocarbon feed as disclosed herein further comprises at least one biocide having weight percentage in the range of 1-15% with respect to the composition.

In an embodiment of the present disclosure, there is provided a composition for dewatering a hydrocarbon feed as disclosed herein further comprises at least one biocide having weight percentage in the range of 2-12% with respect to the composition. In another embodiment of the present disclosure, there is provided a composition for dewatering a hydrocarbon feed as disclosed herein further comprises at least one biocide having weight percentage in the range of 5-10% with respect to the composition. In another embodiment of the present disclosure, there is provided a composition for dewatering a hydrocarbon feed as disclosed herein further comprises at least one biocide having weight percentage of 5% with respect to the composition.

In an embodiment of the present disclosure, there is provided a composition for dewatering a hydrocarbon feed as disclosed herein, wherein the at least two alkyl poly-ethoxy alcohol has a weight percentage in the range of 30-50% with respect to the composition; the at least one non-ionic surfactant has a weight percentage in the range of 30-50% with respect to the composition, and further comprises at least one diluent having weight percentage in the range of 10-30% with respect to the composition and at least one biocide having weight percentage in the range of 1-15% with respect to the composition.

In an embodiment of the present disclosure, there is provided a composition for dewatering a hydrocarbon feed as disclosed herein which further comprises at least one biocide having weight percentage in the range of 1-15% with respect to the composition and wherein the at least one biocide is selected from the group consisting of quaternary $C_{8-18}$ alkyl ammonium chlorides, quaternary $C_{8-18}$ alkanol ammonium chlorides, and bronopol.

In an embodiment of the present disclosure, there is provided a composition for dewatering a hydrocarbon feed as disclosed herein, wherein the at least one diluent is selected from the group consisting of superior kerosene oil, naphtha, hexane, heptane, xylene, ethanol, propanol, butanol, pentanol, hexanol, isooctane, and toluene.

In an embodiment of the present disclosure, there is provided a composition for dewatering a hydrocarbon feed, the composition as disclosed herein, wherein the at least one biocide is selected from the group consisting of quaternary $C_{8-18}$ alkyl ammonium chlorides, quaternary $C_{8-18}$ alkanol ammonium chlorides, and bronopol.

In an embodiment of the present disclosure, there is provided a composition for dewatering a hydrocarbon feed as disclosed herein, further comprises at least one diluent having weight percentage in the range of 10-30% with respect to the composition and wherein the at least one diluent is selected from the group consisting of superior kerosene oil, naphtha, hexane, heptane, xylene, ethanol, propanol, butanol, pentanol, hexanol, isooctane, and toluene.

In an embodiment of the present disclosure, there is provided a composition for dewatering a hydrocarbon feed, the composition as disclosed herein, wherein the at least one biocide is selected from the group consisting of quaternary $C_{8-18}$ alkyl ammonium chlorides or quaternary $C_{8-18}$ alkanol ammonium chlorides. In another embodiment of the present disclosure, there is provided a composition for dewatering a hydrocarbon feed, the composition as disclosed herein, wherein the at least one biocide is selected from quaternary $C_{8-18}$ alkyl ammonium chlorides.

In an embodiment of the present disclosure, there is provided a composition for dewatering a hydrocarbon feed, the composition comprising: a) at least two alkyl poly-ethoxy alcohol selected from the group consisting of polysorbate 20, polysorbate 40, polysorbate 80, polyethylene glycol 200, polyethylene glycol 400, and polyethylene glycol 1500 having a weight percentage in the range of 30-50% with respect to the composition; and b) at least one non-ionic surfactant selected from triton X, octyl phenol alkoxylate, nonylphenol ethoxylate, or tergitol having a weight percentage in the range of 30-50% with respect to the composition, wherein the at least two alkyl poly-ethoxy alcohol to the at least one non-ionic surfactant weight ratio is in the range of 0.75:1.5 to 1.5:3.0, wherein the composition further comprises at least one diluent selected from the group consisting of superior kerosene oil, naphtha, hexane, heptane, xylene, ethanol, propanol, butanol, pentanol, hexanol, isooctane, and toluene having weight percentage in the range of 10-30% with respect to the composition and at least one biocide selected from the group consisting of quaternary $C_{8-18}$ alkyl ammonium chlorides, quaternary $C_{8-18}$ alkanol ammonium chlorides, and bronopol having weight percentage in the range of 1-15% with respect to the composition.

In an embodiment of the present disclosure, there is provided a composition for dewatering a hydrocarbon feed, the composition comprising: a) at least two alkyl poly-ethoxy alcohol is a combination of polysorbate 20 and polysorbate 40 in the weight ratio of 1:1 having a weight percentage in the range of 30-50% with respect to the composition; and b) at least one non-ionic surfactant is triton X having a weight percentage in the range of 30-50% with respect to the composition, wherein the at least two alkyl poly-ethoxy alcohol to the at least one non-ionic surfactant weight ratio is in the range of 0.75:1.5 to 1.5:3.0, wherein the composition further comprises at least one diluent selected from the group consisting of superior kerosene oil, naphtha, hexane, heptane, xylene, ethanol, propanol, butanol, pentanol, hexanol, isooctane, and toluene having weight percentage in the range of 10-30% with respect to the composition and at least one biocide selected from the group consisting of quaternary $C_{8-18}$ alkyl ammonium chlorides, quaternary $C_{8-18}$ alkanol ammonium chlorides, and bronopol having weight percentage in the range of 1-15% with respect to the composition.

In an embodiment of the present disclosure, there is provided a process for process for dewatering a hydrocarbon feed, the process comprising: a) obtaining a hydrocarbon feed; b) obtaining the composition comprising i) at least two alkyl poly-ethoxy alcohol; and ii) at least one non-ionic surfactant, wherein the at least two alkyl poly-ethoxy alcohol to the at least one non-ionic surfactant weight ratio is in the range of 0.75:1.5 to 1.5:3.0; c) contacting the composition with the hydrocarbon feed to separate water and dewatered hydrocarbon feed, wherein the composition is in a weight ratio range of 0.0001 to 0.005% with respect to the hydrocarbon feed.

In an embodiment of the present disclosure, there is provided a process for process for dewatering a hydrocarbon feed as disclosed herein, wherein the hydrocarbon feed is selected from the group consisting of crude oil, light crudes, heavy crudes, and combinations thereof.

In an embodiment of the present disclosure, there is provided a process for process for dewatering a hydrocarbon feed, the process comprising: a) obtaining a hydrocarbon feed selected from the group consisting of crude oil, light crudes, heavy crudes, and combinations thereof; b) obtaining the composition comprising i) at least two alkyl poly-ethoxy alcohol; and ii) at least one non-ionic surfactant, wherein the at least two alkyl poly-ethoxy alcohol to the at least one non-ionic surfactant weight ratio is in the range of 0.75:1.5 to 1.5:3.0; c) contacting the composition with the hydrocarbon feed to separate water and dewatered hydrocarbon feed, wherein the composition is in a weight ratio range of 0.0001 to 0.005% with respect to the hydrocarbon feed.

In an embodiment of the present disclosure, there is provided a process for process for dewatering a hydrocarbon feed as disclosed herein, wherein contacting the composition with the hydrocarbon feed to separate water at a rate in the range of 0.5-5 ml per minute.

In an embodiment of the present disclosure, there is provided a process for process for dewatering a hydrocarbon feed, the process comprising: a) obtaining a hydrocarbon feed selected from the group consisting of crude oil, light crudes, heavy crudes, and combinations thereof, b) obtaining the composition comprising i) at least two alkyl poly-ethoxy alcohol; and ii) at least one non-ionic surfactant, wherein the at least two alkyl poly-ethoxy alcohol to the at least one non-ionic surfactant weight ratio is in the range of 0.75:1.5 to 1.5:3.0; c) contacting the composition with the hydrocarbon feed to separate water and dewatered hydrocarbon feed, wherein the composition is in a weight ratio range of 0.0001 to 0.005% with respect to the hydrocarbon feed.

In an embodiment of the present disclosure, there is provided a process for process for dewatering a hydrocarbon feed, the process comprising: a) obtaining a hydrocarbon feed selected from the group consisting of crude oil, light crudes, heavy crudes, and combinations thereof; b) obtaining the composition comprising i) at least two alkyl poly-ethoxy alcohol; and ii) at least one non-ionic surfactant, wherein the at least two alkyl poly-ethoxy alcohol to the at least one non-ionic surfactant weight ratio is in the range of 0.75:1.5 to 1.5:3.0; iii) at least one diluent having weight percentage in the range of 10-30% with respect to the composition; iv) at least one biocide having weight percentage in the range of 1-15% with respect to the composition; c) contacting the composition with the hydrocarbon feed to separate water and dewatered hydrocarbon feed, wherein the composition is in a weight ratio range of 0.0001 to 0.005% with respect to the hydrocarbon feed.

Although the subject matter has been described in considerable detail with reference to certain preferred embodiments thereof, other embodiments are possible.

EXAMPLES

The disclosure will now be illustrated with working examples, which is intended to illustrate the working of disclosure and not intended to take restrictively to imply any limitations on the scope of the present disclosure. Unless defined otherwise, all technical and scientific terms used herein have the same meaning as commonly understood to one of ordinary skill in the art to which this disclosure belongs. Although methods and materials similar or equivalent to those described herein can be used in the practice of the disclosed methods and compositions, the exemplary methods, devices and materials are described herein. It is to be understood that this disclosure is not limited to particular methods, and experimental conditions described, as such methods and conditions may apply.

With an aim to obtain a dewatering composition for removing free as well as dissolved water in the hydrocarbon feed, the present disclosure provides an indigenous composition comprising at least two alkyl poly-ethoxy alcohol and at least one non-ionic surfactant. Various composition with varying components were prepared and their weight ratios were suitably chosen to obtain an efficient dewatering composition. The dewatering composition further comprises at least one biocide and at least one diluent. The present disclosure also provides a comparative analysis with commercially available dewatering composition as against the dewatering composition of the present disclosure.

Example 1

Materials and Methods

For the purpose of the present disclosure, polysorbate 20 (PS20), polysorbate 40 (PS40), Triton X (TX100), benzalkonium chloride, and toluene were commercially procured.

Composition for Dewatering a Hydrocarbon Feed of the Present Disclosure

The present disclosure reveals a composition for dewatering a hydrocarbon feed comprising at least two alkyl poly-ethoxy alcohol and at least one non-ionic surfactant in the weight ratio range of 0.75:1.5 to 1.5:3.0. The composition was obtained from 30 to 50% of at least two alkyl poly-ethoxy alcohol and 30 to 50% of at least one non-ionic surfactant. The at least two alkyl poly-ethoxy alcohol was selected from polysorbate 20, polysorbate 40, polysorbate 80, polyethylene glycol 200, polyethylene glycol 400, and polyethylene glycol 1500. The non-ionic surfactant was selected from triton X, octyl phenol alkoxylate, nonylphenol ethoxylate, and tergitol. Two alkyl polyethoxy alcohols and a non-ionic surfactant were weighed individually and mixed in a vial and was subjected to stirring at 30° C. for a time period of 5 minutes to result in the transparent and homogenous dewatering composition.

Table 1 shows the various compositions formulated for the purpose of the present disclosure.

TABLE 1

| Composition no | Composition | Water separated (ml) |
|---|---|---|
| F1 | 1% LABSA in PS20 | 1 |
| F2 | 10% LABSA in PS20 | 1 |
| F3 | 25% LABSA in PS20 | 1.4 |
| F4 | 10% TERGITOL in PS20 | 3 |
| F5 | 50% TERGITOL in PS20 | 2.2 |
| F6 | 10% PS80 in PS20 | 3.1 |

TABLE 1-continued

| Composition no | Composition | Water separated (ml) |
|---|---|---|
| F7 | 25% PS80 in PS20 | 3.1 |
| F8 | 50% PS80 in PS20 | 3 |
| F9 | 75% PS80 in PS20 | 3.1 |
| F10 | 10% PS40 in PS20 | 5 |
| F11 | 25% PS40 in PS20 | 3 |
| F12 | 50% PS40 in PS20 | 4 |
| F13 | 75% PS40 in PS20 | 6 |
| F14 | 50% TX 100 in F12 | 25 |
| F15 | 75% TX 100 in F12 | 15 |
| F16 | 25% TX 100 in F12 | 15 |
| F17 | 50% TBAB in PEG400 | 0 |
| F18 | 50% TX 100 in PEG400 | 15 |
| F19 | 50% TBAB in TX 100 | 15 |
| F20 | 75% TX100 in PEG 400 | 16 |
| F21 | 50% TX100 in PEG 400 | 3 |
| F22 | 75% TX100 in PEG 200 | 8 |
| F23 | 50% TX100 in PEG 1500 | 1 |
| F24 | 75% TX100 in PEG 400 | 5 |

LABSA: Linear Alkyl benzene sulphonic acid; PS: Polysorbate; TX: Triton, PEG: Polyethylene Glycol; TBAB: Tetrabutyl Ammonium Bromide Table 1 provides various composition for dewatering the hydrocarbon feed. For example, the first composition denoted by F1 includes 1% of LABSA i.e., Linear Alkyl benzene sulphonic acid and 99% of polysorbate 20. Another composition F12 includes 50% of polysorbate 20 with 50% of polysorbate 40 i.e. 1:1 ratio of PS20 and PS40. Composition F14 includes 50% of triton X 100 in F12 (1:1) i.e. F14 comprised 50% of Triton X 100, 25% of polysorbate 20 and 25% of polysorbate 40. Hence, F14 composition has PS20, PS40, triton X 100 in the ratio of 1:1:2. Similarly, the compositions were prepared as explained in Table 1 and was further used for testing the dewatering capacity in the hydrocarbon feed.

Further, the dewatering composition comprised the biocide and the diluent. The biocide added prevents tank bottom corrosion of the refinery units and the diluent aids in interaction of the components of dewatering composition at the oil-water interface. Hence a dewatering composition comprising 20% of PS20, 20% of PS40, 40% of triton X 100, 5% of benzalkonium chloride and 15% of toluene was prepared and was used for dewatering the hydrocarbon feed.

Evaluation Procedure of Dewatering a Hydrocarbon Feed

In the present disclosure, the hydrocarbon feed was selected from crude oil, light crudes and heavy crudes. For the purpose of the present disclosure, the process for dewatering was carried out in crude oil (CO) with various crude oil samples. The crude oil subjected to dewatering is selected from CO-1, CO-2, CO-3, CO-4 and CO-5 and their physical properties are tabulated below in Table 2.

TABLE 2

| SL NO | CRUDE OIL (CO) | BS&W (vol %) D4007 | Density @ 15 °C (g/cc) D4052 | Sp. Gravity 15/15 °C D4052 | API Gravity D4052 |
|---|---|---|---|---|---|
| 1 | CO-1 | 0.02 | 0.8385 | 0.8394 | 37.08 |
| 2 | CO-2 | 0.5 | 0.8481 | 0.8489 | 35.18 |
| 3 | CO-3 | 0.02 | 0.8295 | 0.8303 | 38.91 |
| 4 | CO-4 | 0.025 | 0.8669 | 0.8750 | 30.26 |
| 5 | CO-5 | 0.2 | 0.8623 | 0.8631 | 32.44 |

The process of dewatering the crude oil (CO-1) with the composition of the present disclosure is explained below. 100 ml of crude oil-water mixture containing (75 ml of crude oil and 25 ml of water) was taken in a measuring cylinder and about 5 ppm of the dewatering compositions as defined in Table 1 was added to the crude oil (CO-1). The mixture was subjected to continuous mechanical shaking and the water separation at various intervals was noted. Extent of water separation was tested using ASTM G170 (section 9.3) method. Table 1 shows the amount of water separated from the crude oil in 15 minutes in the presence of the various dewatering composition. It can be observed that F14 effectively separated 25 ml of water completely in 15 minutes. The other compositions such as F15, F16, F20 was also found to appreciably separate water i.e. 15 ml in 15 minutes from crude oil (CO-1). Thus it can be deduced that the dewatering composition should have ranges as specified in the present disclosure to provide desired results in dewatering process. Hence the dewatering composition F14 was considered the best working composition and was tested further.

For comparative purpose, the commercially available dewatering composition i.e. benchmark additive was tested against the dewatering composition (F14) of the present disclosure. F14 used herein further comprised the 5% of benzalkonium chloride and 20% of toluene.

Process of dewatering the crude oil (CO-1)-water mixture as explained above, was carried out in the presence of benchmark additive and F14 at various compositions such as 2.5 ppm, 5.0 ppm and 10.0 ppm and the extent of water separation is tabulated below in Table 3 and is depicted in FIG. 1. Presence of salt content, oil in water emulsion was also measured. FIG. 1*a* shows the benchmark additive (2.5 ppm, 5.0 ppm and 10.0 ppm) added to the crude oil-water mixture and the extent of water separation. FIG. 1*b* shows the effect of dewatering composition F14 added (2.5 ppm, 5.0 ppm and 10.0 ppm) the crude oil-water mixture and the extent of water separation.

TABLE 3

| Dewatering composition | Dosage (ppm) | Salt content (ptb) | Water content in oil layer (ppm) | Observation |
|---|---|---|---|---|
| Benchmark additive | 2.5 | 4.4 | 9650 | <2 ml of clear water layer |
| | 5.0 | 4.1 | 5936 | <2 ml of clear water layer |
| | 10.0 | 3.9 | 1528 | 20 ml water separated after 1 hour |
| F14 | 2.5 | 3.9 | 1000.9 | 25 ml water separation after 2 hours |
| | 5.0 | 3.9 | 977.8 | 25 ml water separation at 20 minutes |
| | 10.0 | 3.5 | 836.8 | 25 ml water separation within 15 minutes |

From Table 3 and FIG. 1, it can be observed that the benchmark additive used in varying dosage do not provide desired dewatering process. The water content in oil layer is also higher and about 2 ml of clear water layer is observed on the oil layer. Hence the benchmark additive did not effectively separate the water from crude oil. Whereas it can be clearly seen that F14 separated the water from crude oil with minimum of the water content in oil layer and the water gets separated in few minutes i.e. 15 to 20 minutes. And it can also be noted that 5 ppm of F14 results in water separation at a faster rate. Also, on analyzing the salt content in the crude oil after dewatering, it can be seen from Table 3 that F14 aids in reducing the salt content in the crude oil compared to the benchmark additive. Lower the salt content, the crude oil is better in the downstream processing. Hence, the dewatering composition F14 efficiently aids in dewatering process compared to the benchmark additive.

Figure 2:
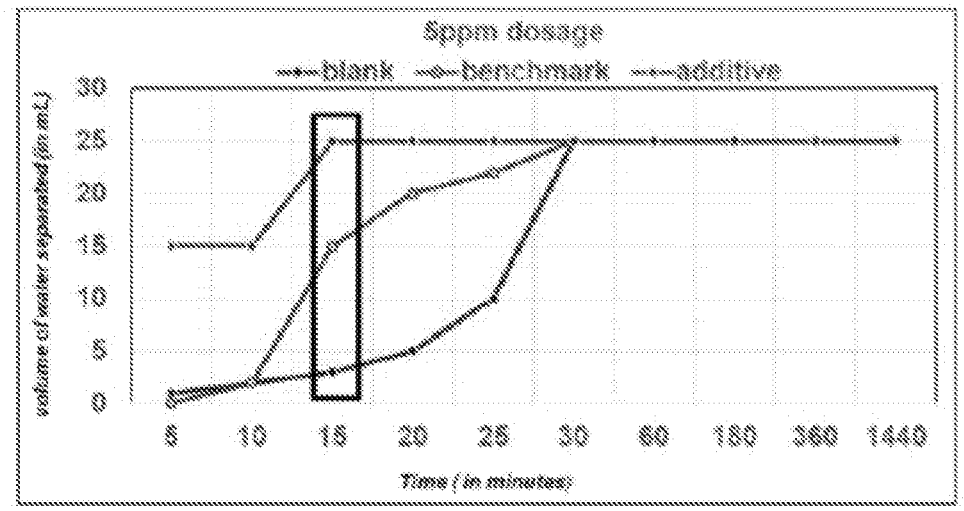
FIG. 2 is a graphical representation of the water separation from hydrocarbon feed (CO-1) at various time intervals in accordance with an implementation of the present disclosure.
Figure 3:
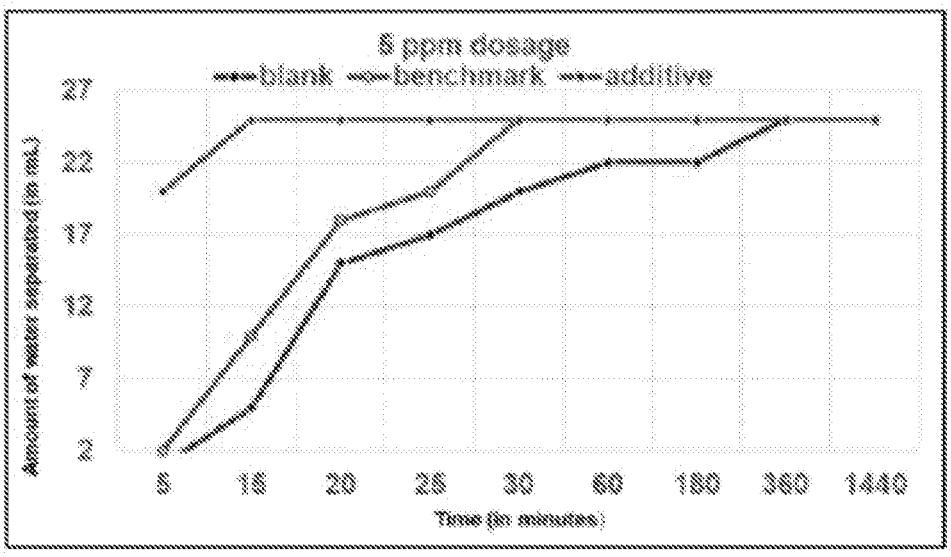
FIG. 3 is a graphical representation of the water separation from hydrocarbon feed (CO-5) at various time intervals in accordance with an implementation of the present disclosure.

Further, the dewatering composition of the present disclosure was evaluated against blank and the benchmark additive. CO-1 and CO-2 were subjected to dewatering process as explained above and the extent of water separation was recorded at various time intervals and is depicted in FIGS. 2 and 3. 5 ppm of F14 and benchmark additive was added to 100 ml of crude oil-water mixture and the water separation was observed. Tables 4 and 5 represents the various time intervals and the amount of water separation from the crude oil-water mixture.

TABLE 4

| Dewatering composition with CO-1 | Amount of water separated (mL) with 5 ppm dosage at various time intervals | | | | | | | | | |
|---|---|---|---|---|---|---|---|---|---|---|
| | 5 min | 10 min | 15 min | 20 min | 25 min | 30 min | 60 min | 180 min | 360 min | 24 hours |
| Blank | 1.0 | 2.0 | 3.0 | 5.0 | 10.0 | 12.0 | 15.0 | 20.0 | 20.0 | 20.0 |
| Benchmark additive | 1.0 | 2.0 | 5.0 | 8.0 | 11.0 | 15.0 | 20.0 | 20.0 | 20.0 | 25.0 |
| F14 | 15.0 | 15.0 | 25.0 | 25.0 | 25.0 | 25.0 | 25.0 | 25.0 | 25.0 | 25.0 |

TABLE 5

| Dewatering composition with CO-5 | Amount of water separated (mL) with 5 ppm dosage at various time intervals | | | | | | | | | |
|---|---|---|---|---|---|---|---|---|---|---|
| | 5 min | 10 min | 15 min | 20 min | 25 min | 30 min | 60 min | 180 min | 360 min | 24 hours |
| Blank | 1.0 | 2.0 | 3.0 | 5.0 | 14.0 | 17.0 | 20.0 | 25.0 | 25.0 | 25.0 |
| Benchmark additive | 2.0 | 5.0 | 10.0 | 18.0 | 20.0 | 25.0 | 25.0 | 25.0 | 25.0 | 25.0 |
| F14 (Additive) | 20.0 | 23.0 | 25.0 | 25.0 | 25.0 | 25.0 | 25.0 | 25.0 | 25.0 | 25.0 |

Figure 4:
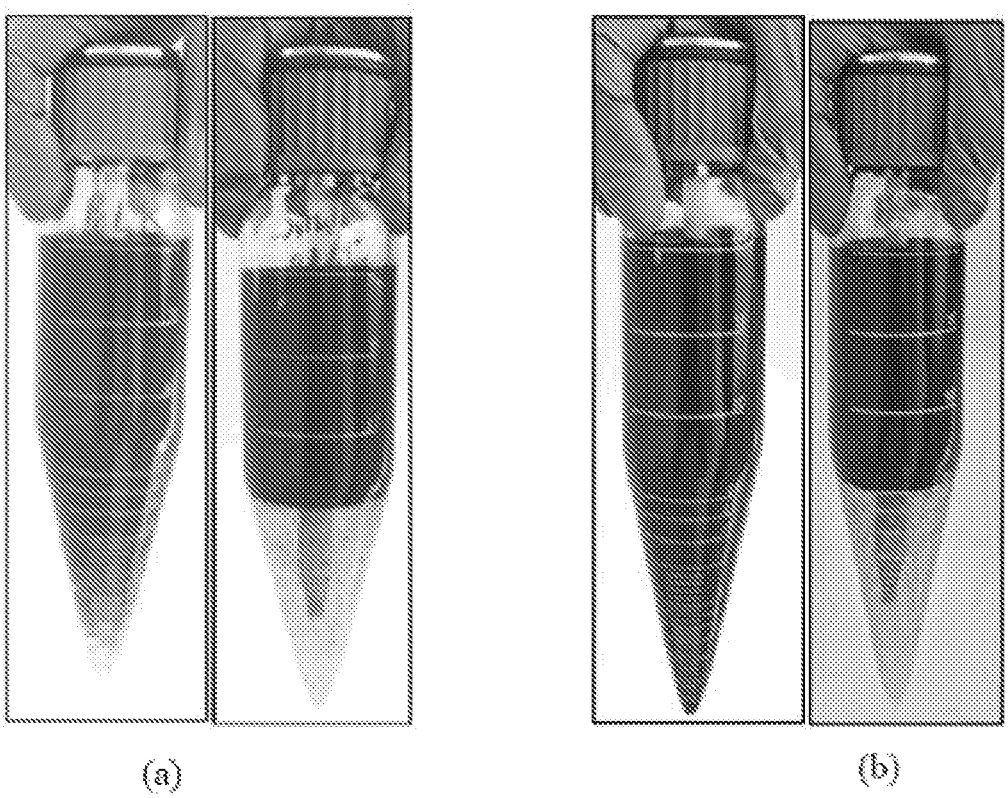
FIG. 4 (*a, b*) represents the images of water separation using dewatering composition of the present disclosure against the blank for the hydrocarbon feed CO-1(a) and CO-5 (b), in accordance with an implementation of the present disclosure.

FIG. 2 and Table 4 clearly illustrate the rate at which water is getting separated from crude oil-water mixture in the presence of dewatering composition (benchmark additive and F14) and absence of dewatering composition (blank). Red curve indicates blank where no dewatering composition is added. Blue curve is for benchmark additive and green line (mentioned as additive in the figure) is for the dewatering composition (F14). After 15 minutes time, maximum water (25 mL) was separated in case of F14 whereas water separated was 15 mL and 3 mL for benchmark and blank respectively, suggesting the effectivity of the present dewatering composition. The images of the vials for blank and F14 are provided in FIG. 4*a*. Similarly, for crude oil-S(CO-5) as per FIG. 3 and Table 5 in first five minutes 20 mL water was separated with F14 whereas only 2 ml and 1 mL were separated in case of benchmark and blank respectively. Complete water separation was observed within 15 min. Images of the vials with blank and F14 is shown in FIG. 4*b*. Thus the above examples clearly signify the faster rate of separation of water from hydrocarbon feed and the rate of water separation fell in the range of 0.5-5 ml per minute. And the dewatering composition (2.5 to 10 ppm) of the present disclosure separates the water at a dosage in the range of 0.0001% to 0.005% with respect to hydrocarbon feed was found to effectively assist the dewatering process. Further the addition of biocide and the diluent to the dewatering composition has an added advantage of avoiding tank bottom corrosion and in aiding maximum water separation from hydrocarbon feed. Moreover the dewatering process of the present disclosure will also effectively minimize the sludge formation.

Although the subject matter has been described in considerable detail with reference to certain examples and implementations thereof, other implementations are possible.

Advantages of the Present Disclosure

The present disclosure reveals a composition for dewatering a hydrocarbon feed comprising at least two alkyl poly-ethoxy alcohol and at least one non-ionic surfactant. The composition further comprises at least one biocide and at least one diluent. The alkyl poly-ethoxy alcohol aids in separation of free water whereas the non-ionic surfactants help in removing the dissolved water from the hydrocarbon feed. The rate of separation of water from the hydrocarbon feed is in the range of 0.5 to 5 ml per minute which is higher than the benchmark additive (commercially available dewatering composition). Dewatering composition is added in the weight percentage range of 0.0001 to 0.005% with respect to hydrocarbon feed. The dosages of dewatering composition are added in minimum but the efficiency of separation of water is appreciably higher. Also the dewatering composition of the present disclosure allow only a meagre amount of water content in oil layer as compared to benchmark additive. Further the dewatering composition of the present disclosure assists in sludge inhibition of the hydrocarbon feed.

We claim:

1. A composition for dewatering a hydrocarbon feed, the composition comprising:

a) at least two alkyl poly-ethoxy alcohol; and b) at least one non-ionic surfactant, wherein the at least two alkyl poly-ethoxy alcohol to the at least one non-ionic surfactant weight ratio is in the range of 0.75:1.5 to 1.5:3.0;

wherein the at least two alkyl poly-ethoxy alcohol is selected from the group consisting of polysorbate 20, polysorbate 40, polysorbate 80, polyethylene glycol 200, polyethylene glycol 400, and polyethylene glycol 1500, and wherein the at least one non-ionic surfactant is selected from triton X, octyl phenol alkoxylate, nonylphenol ethoxylate, and tergitol.

2. The composition as claimed in claim 1, wherein the at least two alkyl poly-ethoxy alcohol is a combination of polysorbate 20 and polysorbate 40.

3. The composition as claimed in claim 2, wherein the polysorbate 20 to the polysorbate 40 weight ratio is 1:1.

4. The composition as claimed in claim 1, wherein the at least one non-ionic surfactant is triton X.

5. The composition as claimed in claim 1, wherein the at least two alkyl poly-ethoxy alcohol has a weight percentage in the range of 30-50% with respect to the composition; the at least one non-ionic surfactant has a weight percentage in the range of 30-50% with respect to the composition.

6. The composition as claimed in claim 1, wherein the composition further comprises at least one diluent having weight percentage in the range of 10-30% with respect to the composition.

7. The composition as claimed in claim 1, wherein the composition further comprises at least one biocide having weight percentage in the range of 1-15% with respect to the composition.

8. The composition as claimed in claim 6, wherein the at least one diluent is selected from the group consisting of superior kerosene oil, naphtha, hexane, heptane, xylene, ethanol, propanol, butanol, pentanol, hexanol, isooctane, and toluene.

9. The composition as claimed in claim 7, wherein the at least one biocide is selected from the group consisting of quaternary C8-18 alkyl ammonium chlorides, quaternary C8-18 alkanol ammonium chlorides, and bronopol.

10. A process for dewatering a hydrocarbon feed, the process comprising:

a. obtaining a hydrocarbon feed;

b. obtaining the composition of claim 1;

c. contacting the composition with the hydrocarbon feed to separate water and dewatered hydrocarbon feed, wherein the composition is in a weight ratio range of 0.0001 to 0.005% with respect to the hydrocarbon feed.

11. The process as claimed in claim 10, wherein the hydrocarbon feed is selected from the group consisting of crude oil, light crudes, heavy crudes, and combinations thereof.

* * * * *